United States Patent [19]

Chomczyk et al.

[11] 3,999,898

[45] Dec. 28, 1976

[54] AUTOMATIC PRESSURE VALVE INTENDED FOR COMPRESSORS

[75] Inventors: Włodimierz Chomczyk; Włodzimierz Chilimoniuk, both of Bialystok, Poland

[73] Assignee: "ASPA" Zaklady Aparatury Spawalniczej Im. Komuny Paryskiej, Wroclaw, Poland

[22] Filed: May 31, 1974

[21] Appl. No.: 475,147

[52] U.S. Cl. ..... 417/443; 137/512.1; 137/512.2; 417/570

[51] Int. Cl.[2] ..... F16K 15/02

[58] Field of Search ..... 137/512.1, 512.2; 417/443, 504, 570

[56] References Cited

UNITED STATES PATENTS

| | | | |
|---|---|---|---|
| 1,225,817 | 5/1917 | Howe | 417/504 |
| 1,307,061 | 6/1919 | Olsen | 417/570 X |
| 1,628,944 | 5/1927 | Wright et al. | 417/570 X |
| 2,751,146 | 6/1956 | Moseley | 417/443 X |
| 3,704,079 | 11/1972 | Berlyn | 417/443 X |

*Primary Examiner*—Robert G. Nilson

[57] ABSTRACT

An automatic pressure valve primarily intended for use in compressors comprising a closing element in the form of a plate, a valve seat with a valve seat face, springs and a stop, the closing plate being so situated in the closed state of the valve that the face of the plate at the cylinder side is below the outer dead center position of the piston. In its top position, the closing element forms with the valve seat face a toroidal shaped gap which in axial section is similar in shape to a De Laval nozzle. The closing element is moved to its lower position, namely into contact with the valve seat face by lowering of the piston on which it rests.

7 Claims, 4 Drawing Figures

AUTOMATIC PRESSURE VALVE INTENDED FOR COMPRESSORS

Figure 1:
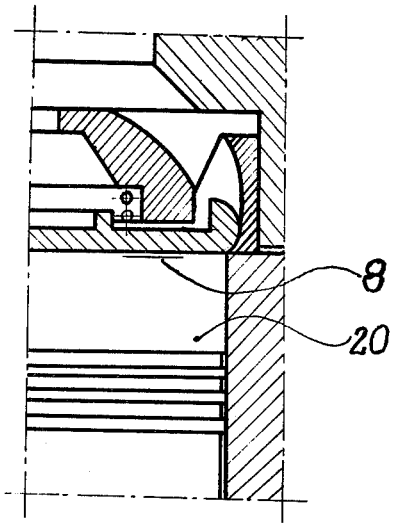

The invention relates to an automatic pressure valve intended particularly for use in compressors.

There are known pressure valves such as in U.S. Pat. No. 855,050, in which the valve strikes, while closing, against the valve face with a force resulting from the pressure of the medium compressed within the duct, the force of the spring and the forces which are the product of the mass and acceleration of elements which are closing the valves. In the known valves the gap produced at the time when the valve is open is not satisfactory in shape.

The known valves are not satisfactorily durable and they have other imperfections such as noisy operation, leakage of compressed medium through the valve when the valve faces and valve closing elements become worn, there is a large clearance space having a negative effect on the quantity of the medium induced into the compression chamber, the shape of the stream of the flowing medium is usually complicated, there are high valve losses, the construction of the valves and their production are complex, the valve is not sufficiently durable in service and its operation is not too reliable, the materials used for production the valves must be of high quality, there is little possibility of using a single pressure valve in the case of a cylinder of large bore because in such a case the mass of the valve closing element is large; the use of a single pressure valve is also not possible if gas-liquid and liquid mixtures are used.

An object of the present invention is to develop a pressure valve of a construction to obviate or mitigate the above described imperfections.

In order to attain this object a durable and quietly operating valve has been developed, said valve having a small or a "zero" clearance space and permitting complete and quick evacuation of the compression space as well as an increased number of working cycles within a given time so that a medium stream of suitably better shape is obtained.

When the pressure valve of the invention is closed, the bottom face of the valve closing element is in a position below the outer dead center of the piston crown, so that the valve closing element is moved by the piston to the valve seat face thus reducing the impact of the valve closing element against the valve seat face. Additionally, when the valve is being opened, the valve closing elements, valve seats and stops define due to the geometrical shapes of their faces, a toroidal gap which in its axial section is similar to a De Laval nozzle. This gap may also be of other shape. The closing elements are pressed down by means of springs. The closing elements take their position on the piston crown at the moment when the piston reaches its outer dead center position or when it approaches the seating of the closing elements in the seats follows with simultaneous closing of the valve, at the moment when the piston crown passes the plane of the position of the inner face of the closing element when the valve is closed. At this moment the piston begins to move toward its inner dead center. Lifting of the closing element and opening of the valve follows automatically if at the moment when the piston moves toward its outer dead center there is a pressure difference across the said lifting element. The stroke of the lifting element is limited by means of a stop.

Figure 2:
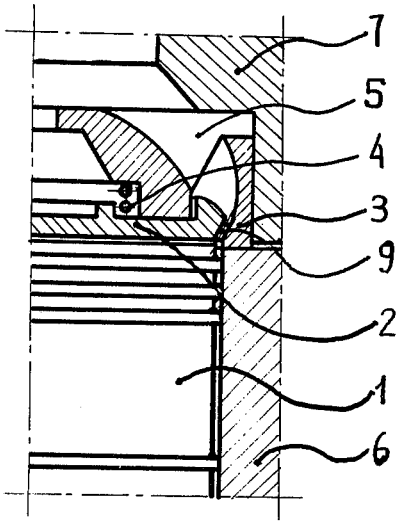
Figure 3:
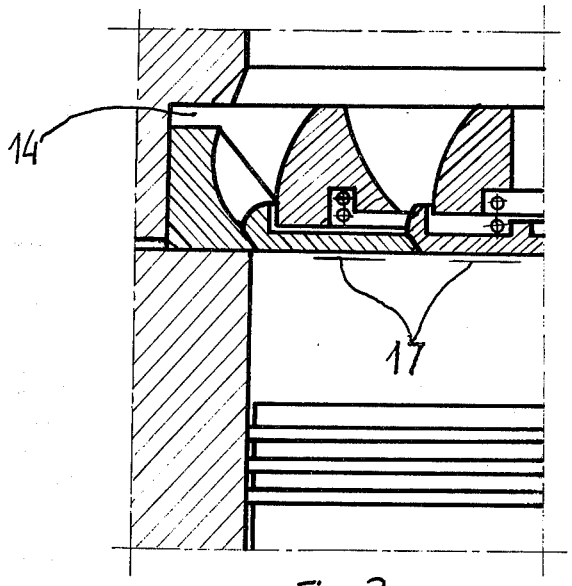
Figure 4:
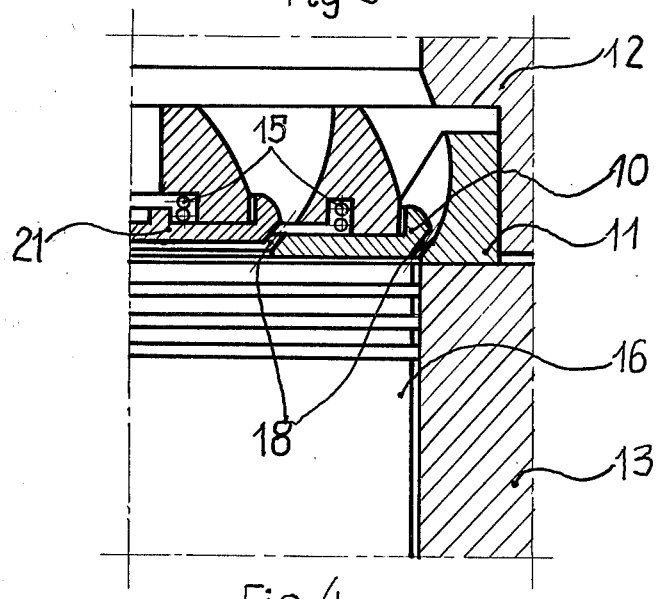

The characteristic features of the invention directed to pressure valves with closing elements which are moved by the piston to the valve seat faces are that:

the closing elements are moved by means of a piston to the valve seat faces and therefore the impact of these elements against the valve seat faces is reduced because the closing elements transmitting their energy to the piston; in consequence materials of lower quality may be used for the valves, the stroke of the closing element may be divided in steps in accordance with FIGS. 3 and 4; the relative stroke of one of the closing elements of such a construction is smaller than the stroke of one element in accordance with FIGS. 1 and 2. The reduction of this stroke is directly proportional to the number of shims, the energy delivered for compression of the medium is recovered after forcing out of the medium is completed, namely the closing element acts on the piston with a force $P = p \cdot F$ in the direction of the inner dead center of the piston over the distance $h$, where $p$ is the pressure in the pressure duct, F is the cross-sectional area in the cylinder and $h$ is the distance between the top dead center of the piston and the bottom position of the inner face of the closing element, namely the face which is closest to the crankshaft, a large cross-section of the stream of the flowing medium and suitable shape of the stream, e.g. a toroidal shape, may be obtained, this shape being similar in its axial section to a Laval nozzle, and hence a considerable reduction of flow resistance takes place even though the stroke of the closing element is very small, a stratiform discharge of the medium may be obtained during evacuation of the cylinder, a large number of working cycles may be obtained in a unit of time even of the order of several thousands per minute, the valve may be used for cylinders of large bores, the valve may be used in machines in which the compressed medium is not only the gas but may also be a mixture of gas and liquid or only liquid.

The construction is simple, and the closing elements may be press or injection formed, the valve has a longer service life, its operation is more reliable and more quiet in comparison with other valves.

The invention will now be described by way of example with reference to the accompanying drawing in which FIG. 1 is a half-sectional view of a pressure valve with a single-member closing element in its opened state, FIG. 2 is a half-sectional view of the pressure valve in its closed state, FIG. 3 is a half-sectional view of a pressure valve with multi-member closing elements in its opposed state, and FIG. 4 is a half-sectional view of the pressure valve of FIG. 3 it its opened state.

Frames 1 and 2 show a valve which consists of a closing element 2, which is moved by piston 1 away from a face of valve seat 3, said valve seat being installed in head 7 of cylinder 6, said valve including also a spring 4 and a stop 5. FIGS. 3 and 4 illustrate a modified version of the pressure valve, in which a multi-member closing element 10 is provided, said element consisting of two or more members made in such a manner that every second member forms a valve seat for every first member. When closing, the last element rests against a valve seat face 11, said valve seat being installed in head 12 in cylinder 13 a stop 14 with springs 15 is installed in the said head, said cylinder 13 accomodating a piston 16. At the moment when the piston 1 illustrated in FIGS. 1 and 2 moves toward its outer dead center positions the compressed medium lifts the closing element 2. The lifted element 2, the valve seat 3 and the stop 5 define a toroidal shaped gap, said gap having in its axial section a shape similar to that of a De Laval nozzle. A nozzle of such a shape enables a faster discharge of compressed medium from the cylinder, this discharge taking place at a minimum flow resistance.

In its outer dead center position, the crown of the piston 1 moves past the extreme inner position of closing element 2. Such position of closing element 2 in relation to the piston 1 enables the said closing element to be contacted by the piston 1 and, upon movement of the piston to its inner dead center positions, the closing element rests on piston 1 until it has moved to its seated position on valve seat face 3. This mode of closing of compression chamber strong striking of the element 2 against the valve seat face 3, prevents valve deformation and leaking of the compressed medium past the deformed valve, adds to a quiet operation of the valve and improves the reliability of the valve since the closing element can have a large mass. The possibility of using closing elements of large mass allows elements of wide geometrical and material variety to be used in compressors without the risk of impairing the performance of the valve system. In the modified version of the valve illustrated in FIGS. 3 and 4, the elements 10 and 21 form a multi-member closing plate. Opening and closing of the valve is effected by the difference in pressures acting on the closing elements. The stroke of the closing plate consists of the sum of the strokes of its individual elements 10 and 21. The stroke, on the other hand, of each separate element is decreased by the stroke of the other element. A multi-member closing plate with graduation of stroke of its individual elements allows the elements 10 and 21, to be of large mass, and suitable various characteristics of construction may satisfactorily be used.

What we claim is:

1. An automatic pressure valve for a compressor having a piston, a cylinder and a cylinder head, the piston being movable in the cylinder between upper and lower dead center positions, said valve comprising a closing element, a sealing plate mounted in the head for being engaged by the closing element to form a sealed closure therewith, a stop fixed in the head, and spring means engaged by the stop and acting on the closing element to urge the same towards the sealing plate, said closing element having a lower face which in closed state of the valve is at a level below the upper dead center position of the piston such that when the piston moves to said upper dead center position, the closing element is lifted from the sealing plate and rests on the piston, and when the piston lowers, the spring means maintains the closing element on the piston and the closing element lowers with said piston for deposit on said sealing plate, said closing element having an outer peripheral surface facing an inner peripheral surface of the sealing plate, said peripheral surfaces being shaped to define a passageway of De Laval nozzle shape when the valve is opened.

2. A valve as claimed in claim 1 wherein said outer peripheral surface of the closing element is conical and convex and said inner peripheral surface of the sealing plate is conical and concave.

3. A valve as claimed in claim 2 wherein said stop has an outer surface in continuation of said outer peripheral surface of the closing element to form with said head a prolongation of the De Laval.

4. A valve as claimed in claim 1 wherein said closing element has an upper surface against which said spring means bears, said upper surface of the closing element being otherwise free for axial and transversal displacement.

5. An automatic pressure valve for a compressor having a piston, a cylinder and a cylinder head, the piston being movable in the cylinder between upper and lower dead center positions, said valve comprising a closing element, a sealing plate mounted in the head for being engaged by the closing element to form a sealed closure therewith, a stop fixed in the head, and spring means engaged by the stop and acting on the closing element to urge the same towards the sealing plate, said closing element having a lower face which in closed state of the valve is at a level below the upper dead center position of the piston such that when the piston moves to said upper dead center position, the closing element is lifted from the sealing plate and rests on the piston, and when the piston lowers, the spring means maintains the closing element on the piston and the closing element lowers with said piston for deposit on said sealing plate, said closing element comprising a plurality of members respectively displaceable axially by said piston and including adjacent sections which come into sealing engagement with one another when the piston is lowered towards the lower dead center position and the closing element is engaged with said sealing plate.

6. A valve as claimed in claim 5 wherein one said stop and spring means is provided for each member of said closing element.

7. A valve as claimed in claim 6 wherein a first of said members of said closing element is an outer member which has an outer peripheral surface for engaging an inner peripheral surface on the sealing plate, and a second of said members of said closing element is an inner member having an outer peripheral surface for engaging an inner peripheral surface on the first said member, the respective inner and outer surfaces being shaped to define passageways of De Laval nozzle shape.

* * * * *